US011607697B2

(12) United States Patent
Lo

(10) Patent No.: US 11,607,697 B2
(45) Date of Patent: Mar. 21, 2023

(54) SPRAYER ABLE TO ADJUST FLOW OF MIXED SOLUTION AND WATER

(71) Applicant: YUAN MEI CORP., Changhua County (TW)

(72) Inventor: Shun-Nan Lo, Changhua County (TW)

(73) Assignee: YUAN MEI CORP., Changhua County (TW)

( * ) Notice: Subject to any disclaimer, the term of this patent is extended or adjusted under 35 U.S.C. 154(b) by 103 days.

(21) Appl. No.: 17/344,908

(22) Filed: Jun. 10, 2021

(65) Prior Publication Data

US 2022/0297144 A1 Sep. 22, 2022

(30) Foreign Application Priority Data

Mar. 17, 2021 (TW) ..... 110109556

(51) Int. Cl.
*B05B 7/12* (2006.01)
*B05B 7/04* (2006.01)

(52) U.S. Cl.
CPC ..... *B05B 7/1209* (2013.01); *B05B 7/0408* (2013.01)

(58) Field of Classification Search
CPC ..... B05B 7/0425; B05B 7/12; B05B 7/2443; B05B 12/002; B05B 12/1418; B05B 1/1654
USPC ..... 222/360, 361, 145.5, 145.7; 239/310, 239/318, 525.526, 581.1
See application file for complete search history.

(56) References Cited

U.S. PATENT DOCUMENTS 3,254,844 A 6/1966 Blasnik et al.
RE29,405 E 9/1977 Gunzel, Jr. et al.
4,475,689 A 10/1984 Hauger et al.
4,708,292 A 11/1987 Gammons
5,213,265 A * 5/1993 Englhard ..... B05B 7/2448 222/484
5,445,288 A 8/1995 Banks
5,595,345 A 1/1997 Chura et al.
5,755,384 A 5/1998 Foster et al.
5,881,955 A 3/1999 Styne
6,283,385 B1 * 9/2001 Beaver ..... B05B 7/2443 239/10
6,425,534 B2 * 7/2002 Ketcham ..... B05B 7/2472 137/893
6,726,123 B2 * 4/2004 Wang ..... B05B 7/12 239/394
6,772,966 B2 * 8/2004 Foster ..... B05B 1/28 239/378
6,966,503 B1 11/2005 Chen
7,004,356 B1 2/2006 Kanfer
7,118,049 B2 * 10/2006 Dodd ..... B05B 7/1209 239/347
7,124,962 B1 10/2006 Fryan et al.
7,237,728 B1 7/2007 Laible
7,303,099 B2 12/2007 Ophardt
(Continued)

*Primary Examiner* — Lien M Ngo
(74) *Attorney, Agent, or Firm* — Raymond Chan

(57) ABSTRACT

A sprayer able to adjust a flow of mixed solution and water is revealed. The sprayer can be used for cleaning objects, spraying mixed solution for agricultural purposes, and so on. The mixed solution is formed by liquid mixed with water while the liquid can be fertilizers, pesticides, detergents, and etc. The sprayer not only can spray out the mixed solution or water selectively, but also can adjust concentration and flow of the liquid.

13 Claims, 20 Drawing Sheets

(56) References Cited

U.S. PATENT DOCUMENTS

| | | | | |
|---|---|---|---|---|
| 7,445,167 | B1 * | 11/2008 | Chen | B05B 7/2445 239/525 |
| 7,661,604 | B1 | 2/2010 | MacLean-Blevins | |
| 7,753,288 | B2 * | 7/2010 | MacLean-Blevins | B05B 7/12 137/895 |
| 7,866,626 | B1 * | 1/2011 | MacLean-Blevins | B05B 1/3026 239/570 |
| D650,046 | S | 12/2011 | Goodwin et al. | |
| D670,982 | S | 11/2012 | Goodwin et al. | |
| 8,608,091 | B2 | 12/2013 | Murray et al. | |
| 8,726,939 | B2 * | 5/2014 | Laible | B05B 7/12 137/892 |
| D708,301 | S | 7/2014 | Jackson et al. | |
| 8,763,863 | B2 | 7/2014 | Quinlan et al. | |
| 8,814,005 | B2 | 8/2014 | Banks et al. | |
| 9,072,412 | B2 | 7/2015 | Ciavarella et al. | |
| 9,561,516 | B2 | 2/2017 | Decker | |
| 9,630,767 | B2 | 4/2017 | Gantenbein et al. | |
| 9,663,927 | B2 * | 5/2017 | Lo | E03C 1/023 |
| 9,950,302 | B1 | 4/2018 | Walsh et al. | |
| 9,980,430 | B2 | 5/2018 | Goodwin et al. | |
| 10,022,742 | B2 | 7/2018 | Goodwin et al. | |
| 10,138,110 | B2 * | 11/2018 | Bates | B05B 15/62 |
| 10,582,830 | B2 | 3/2020 | Fasson | |
| 2004/0135011 | A1 | 7/2004 | Shanklin et al. | |
| 2004/0217205 | A1 | 11/2004 | Kohs | |
| 2005/0173567 | A1 | 8/2005 | Shanklin et al. | |
| 2005/0184171 | A1 | 8/2005 | Shanklin et al. | |
| 2005/0189436 | A1 | 9/2005 | Shanklin et al. | |
| 2005/0199751 | A1 | 9/2005 | Shanklin et al. | |
| 2005/0211280 | A1 | 9/2005 | Liu | |
| 2006/0091237 | A1 | 5/2006 | Dodd | |
| 2006/0151634 | A1 | 7/2006 | Pivovrov | |
| 2010/0163646 | A1 | 7/2010 | Havlovitz et al. | |
| 2014/0076996 | A1 | 3/2014 | Hayton et al. | |
| 2016/0059253 | A1 | 3/2016 | Gooden et al. | |
| 2018/0043378 | A1 | 2/2018 | Gantenbein et al. | |
| 2018/0085766 | A1 | 3/2018 | Gantenbein et al. | |
| 2018/0207667 | A1 | 7/2018 | Black et al. | |
| 2019/0105671 | A1 | 4/2019 | Carpanese | |
| 2022/0193705 | A1 * | 6/2022 | Chen | B05B 7/0425 |

* cited by examiner

SPRAYER ABLE TO ADJUST FLOW OF MIXED SOLUTION AND WATER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a sprayer able to adjust a flow of mixed solution and water, especially to a sprayer able to adjust a flow of mixed solution and water which siphons liquid and mixes the liquid with water to form mixed solution with bubbles being sprayed onto a place to be treated. The flow of the liquid drawn off can be adjusted. The sprayer can spray out not only the mixed solution, but also water for various purposes.

Description of Related Arts

Refer to U.S. Pat. No. 5,595,345, a double barrel sprayer for applying a diluted product is revealed. Some kind of liquid detergent is mixed with water. One end of the sprayer is connected to an inlet of a gardening hose while the other end of the sprayer is joined with a container which is filled with the liquid detergent. Water or a bubble solution formed by diluted liquid detergent mixed with air is sprayed out through a nozzle of the sprayer. The liquid detergent is mixed with water to form diluted liquid detergent in the container and the water is flowing into the container after each spraying process. Thus the liquid detergent in the container will gradually be diluted by the water. Another disadvantage of such sprayer is in that the member used for introducing air into the sprayer is exposed outside that the exposed air inlet may be blocked by the bubbles generated, rendering poor performance. Besides, the product with such design is not aesthetically pleasing.

SUMMARY OF THE PRESENT INVENTION

Therefore, it is a primary object of the present invention to provide a sprayer able to adjust a flow of mixed solution and water in which liquid and water are mixed to form a bubble solution or mixed solution. The liquid can be fertilizers, pesticides, detergents, and etc. The sprayer is mainly used to adjust the concentration and flow of the liquid being sprayed out.

In order to achieve the above and other objects, a sprayer able to adjust a flow of mixed solution and water according to the present invention includes an operation portion and a housing. The operation portion is composed of a first end connected to a hose, a second end connected to the housing, and a water inlet channel. The hose is connected to a faucet for water supply and the housing is connected to a container, which can be filled with liquid for providing the liquid to the sprayer. An adjustment portion is arranged at the housing which consists of a diversion chamber and a plurality of distribution channels communicating with the diversion chamber. The diversion chamber includes a first diversion port and a second diversion port while the distribution channels include a first distribution channel, a second distribution channel, and a third distribution channel. The adjustment portion is provided with a ramp and a selector which can be aligned with the first diversion port or the second diversion port of the diversion chamber to close the first diversion port or the second diversion port selectively. The first diversion port is communicated with both the first distribution channel and the second distribution channel while the second diversion port is communicated with the third distribution channel. The housing further includes a liquid storage room. A siphon channel communicated with the container is arranged at the liquid storage room and is provided with a valve used to control the opening and closing of an opening of the siphon channel and further control the opening and closing and the amount of the liquid flowing from the container to the liquid storage room. One end of the valve is aligned with the ramp of the adjustment portion so that vertical movement of the valve under control of the ramp aligned with the valve. One end of the housing is connected to a spray portion which is provided with a clear-water channel and a mixture channel communicating with second distribution channel and the third distribution channel respectively. The spray portion further includes a spray head which is provided with a plurality of clear-water nozzles with different spray patterns and a mixture nozzle for spraying out the mixed solution (such as bubble solution). The user may rotate an adjustment portion thereof to spray out mixed solution selectively. Water is introduced by the operation portion to generate a negative pressure. Thereby liquid in the container is delivered to the siphon channel through the liquid pipe due to siphon effect. The opening of the siphon channel is opened by the valve, so that the liquid is drawn into the liquid storage room and mixed with water from the second diversion port to form a diluted solution. Lastly, the diluted solution is blended with air in the mixture channel to get bubble solution and then sprayed out through the mixture nozzle. The user may rotate the adjustment portion to spray out water selectively. By the selector aligned with the first diversion port and closing the second diversion port selectively, water introduced by the operation portion is flowing through the first distribution channel, the diversion chamber, entering the first diversion port, going through the second distribution channel and arriving the clear-water channel to be sprayed out through the spray head. The spray head is manually rotated to select one of the clear-water nozzles aligned with the clear-water channel to spray out the water in different patterns, such as linear splash or radial splash.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn features and functions of the present invention, please refer to the following detailed description of the preferred embodiments and the related drawings.

The present invention provides a sprayer which is connected to a free end of a hose (such as garden hose) and used for mixing liquid, adjusting concentration and flow of liquid, and providing multiple spray modes. One end of the hose is connected to a faucet so that water is delivered to the sprayer by the hose.

The sprayer not only can spray water or mixed solution but also adjust concentration and flow. The mixed solution is formed by water blended with liquid which is a liquid compound such as a fertilizer, a pesticide, a detergent, their combinations, and etc.

Figure 1:
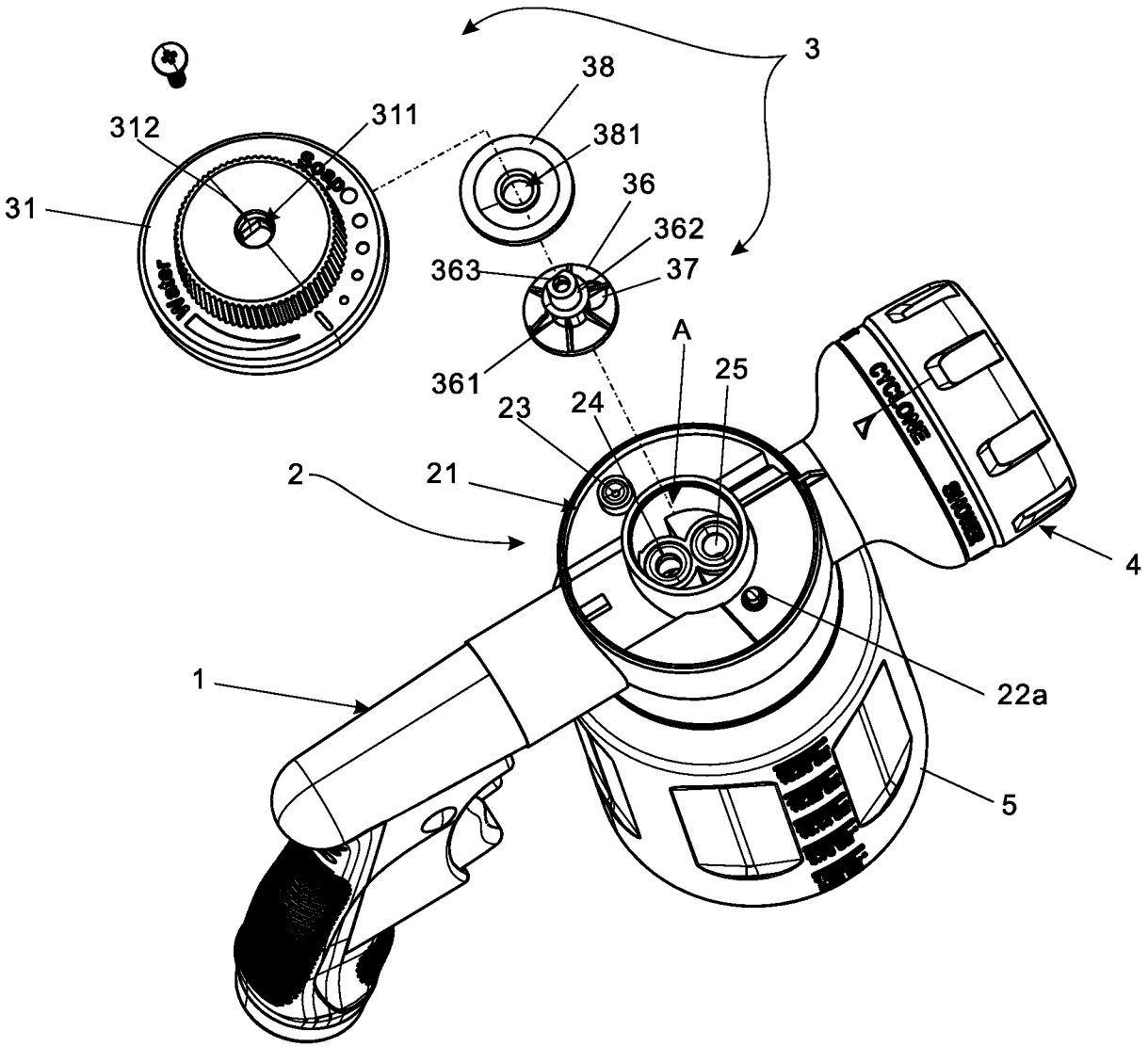
FIG. 1 is a partial assembly diagram and a partial exploded view of an embodiment according to the present invention.
Figure 2:
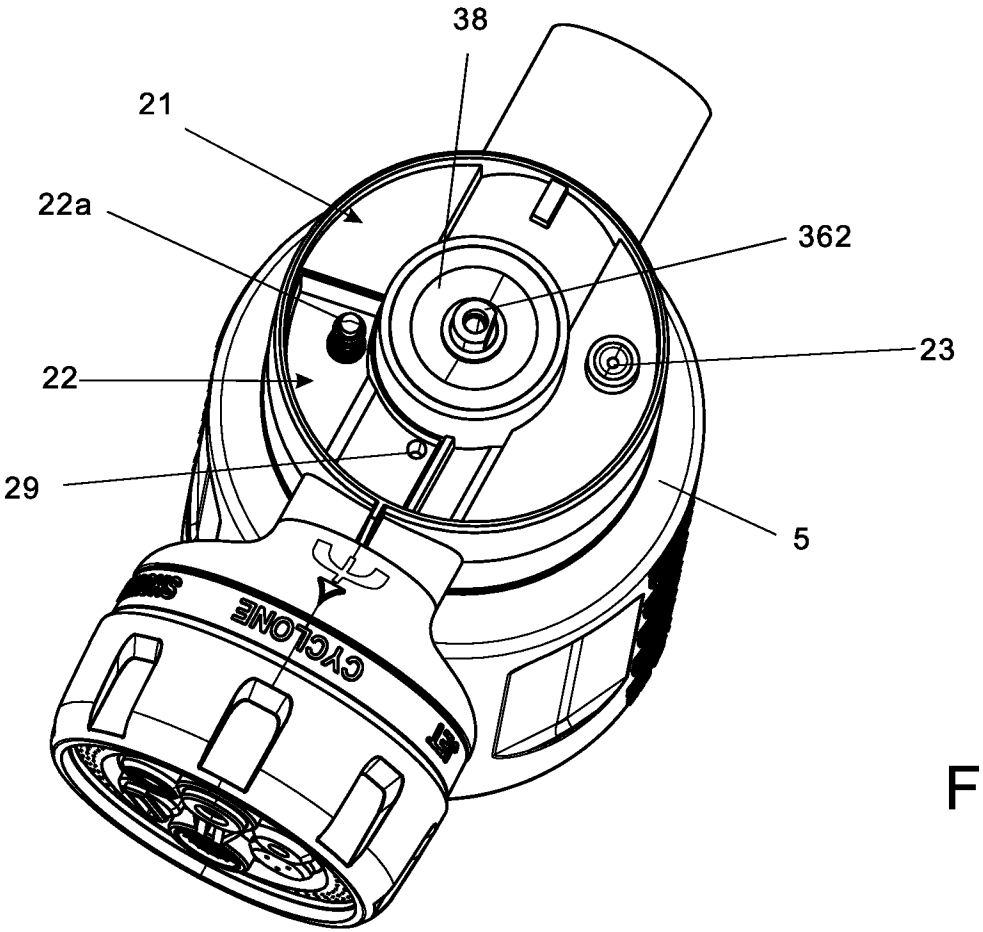
FIG. 2 is a partial perspective view of an embodiment according to the present invention.
Figure 11:
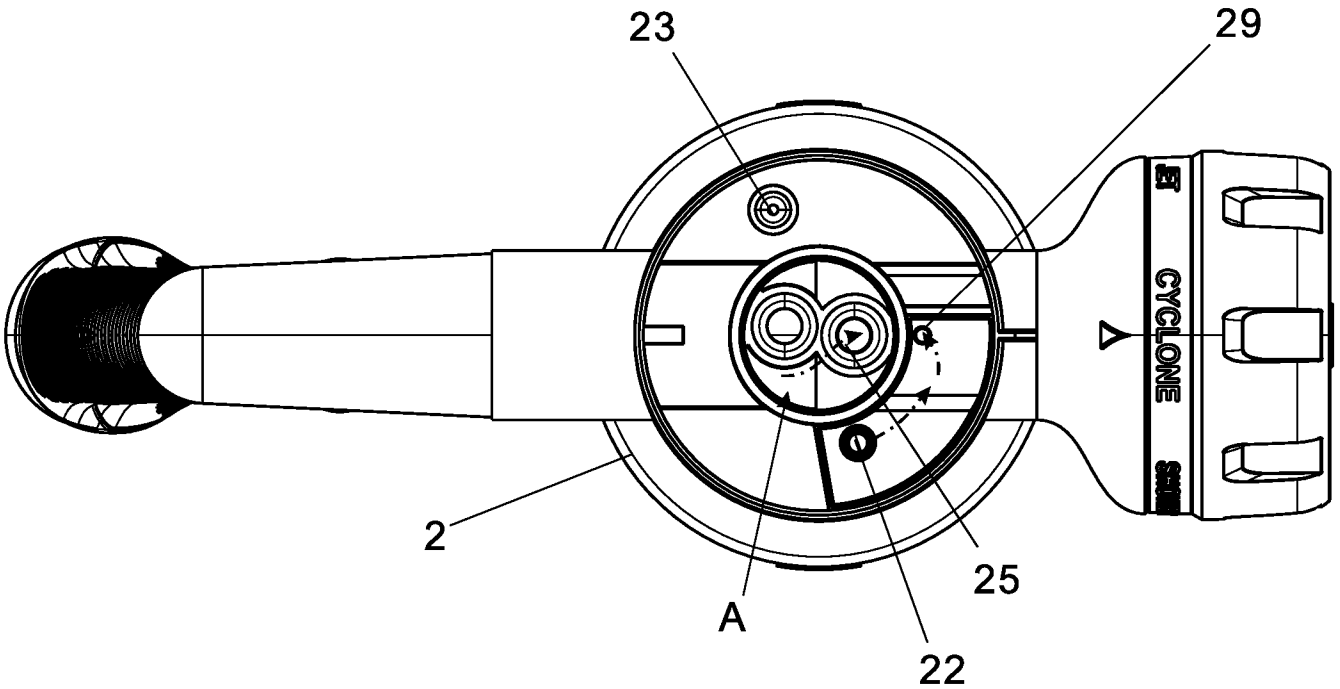
FIG. 11 is a sectional view of an embodiment according to the present invention assembled with a container.
Figure 12:
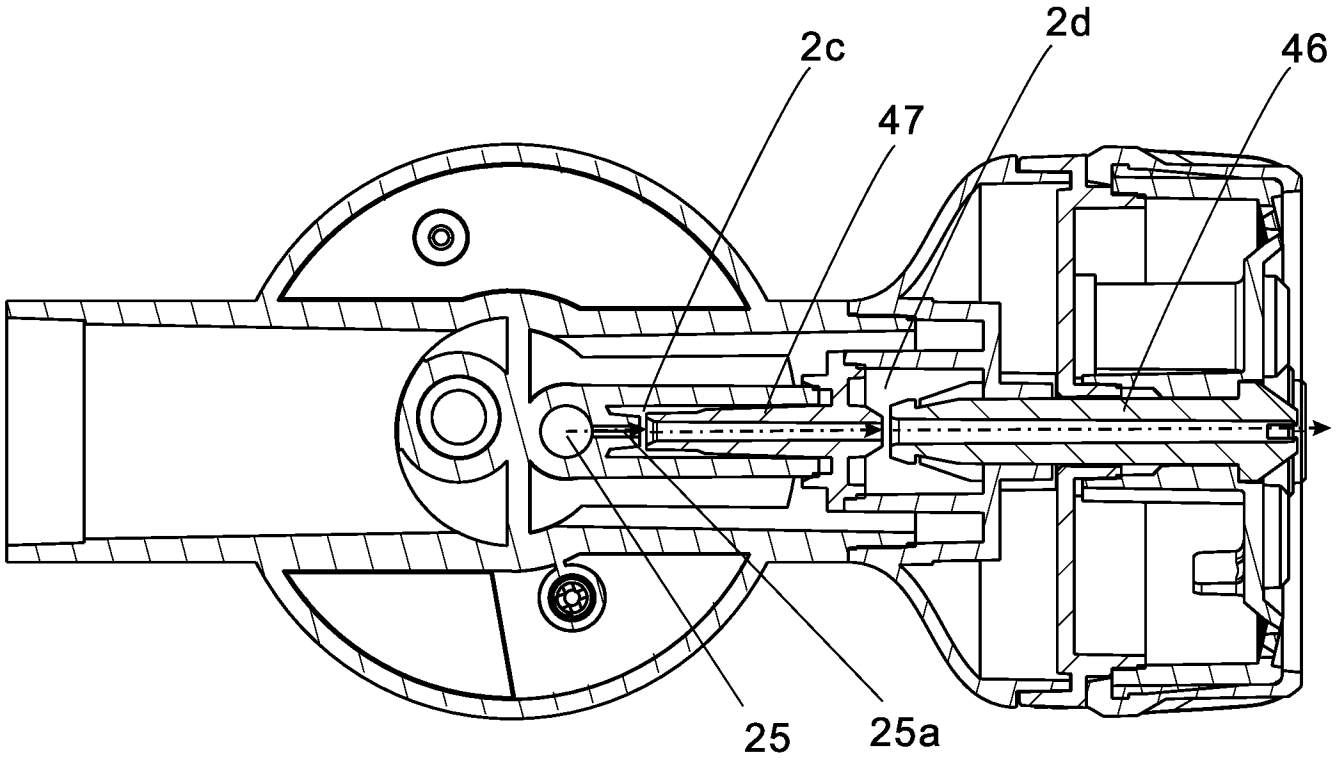
FIG. 12 is a top view of a cross section of an embodiment according to the present invention.
Figure 13:
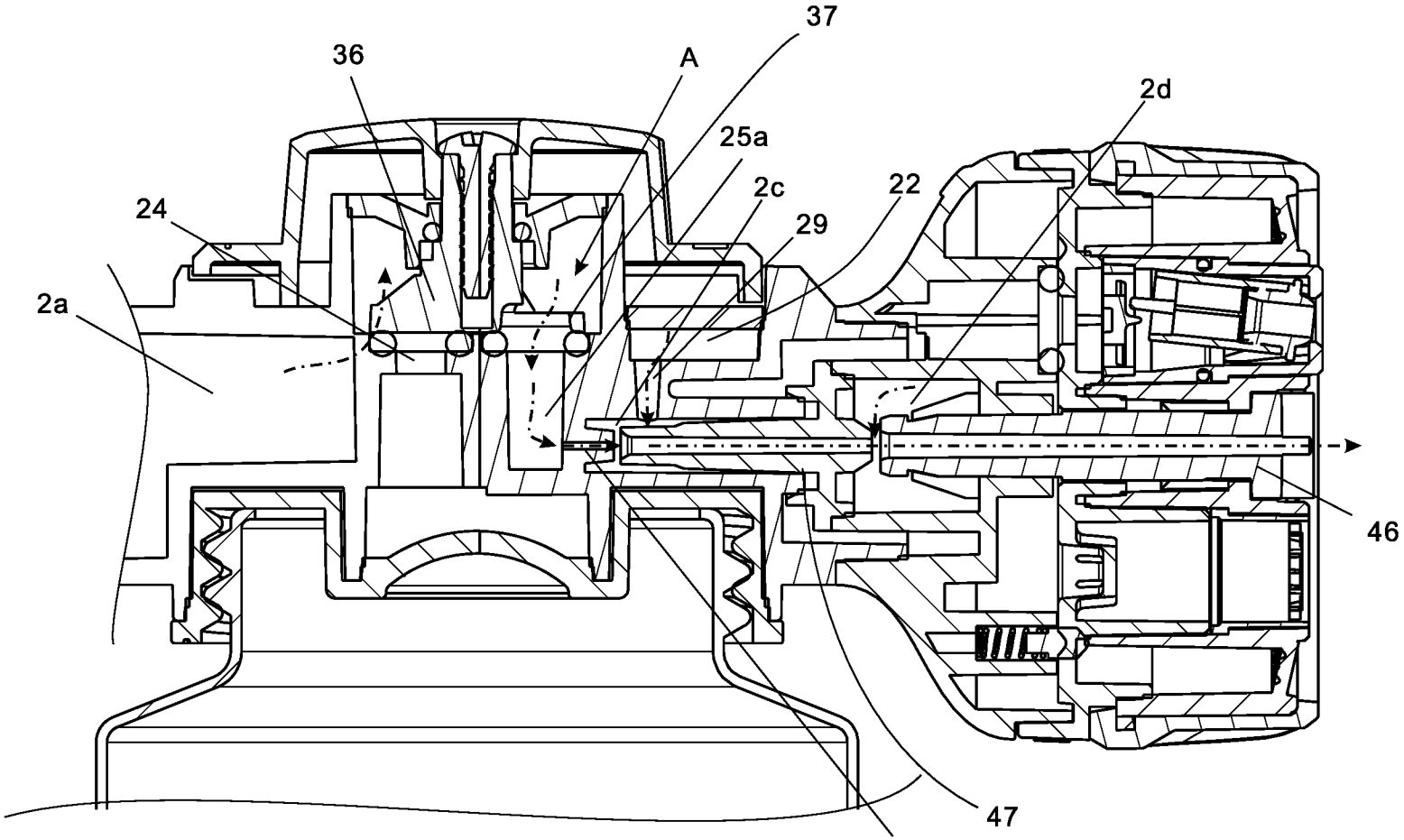
FIG. 13 is a partial enlarged sectional view of an embodiment according to the present invention.
Figure 14:
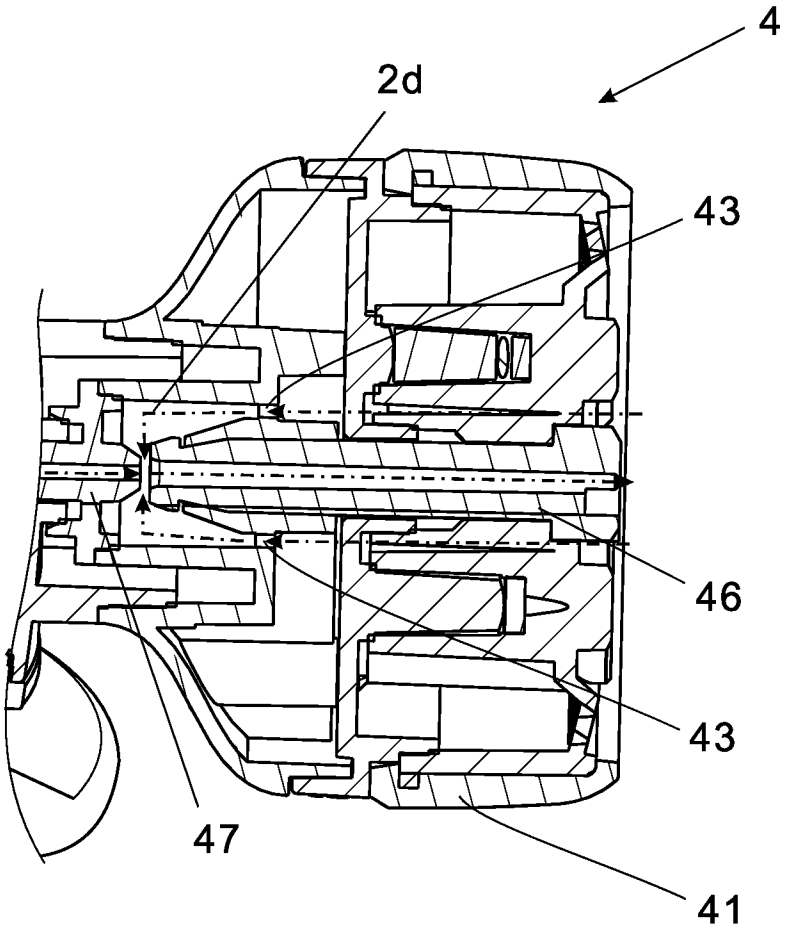
FIG. 14 is a partial enlarged cross-sectional view of a spray portion of an embodiment according to the present invention.

As shown in FIG. 1 and FIG. 11, the sprayer is connected to a container 5 which is filled with liquid and provided with a liquid pipe 51. The liquid can be concentrated detergent solution and the liquid pipe 51 is connected to the sprayer so that the liquid in the container 5 can be delivered to the sprayer due to siphon effect and mixed with water to form diluted solution with bubbles being sprayed out.

Referring to FIGS. 1-5, a sprayer according to the present invention includes an operation portion 1, a housing 2, an adjustment portion 3, and a spray portion 4.

One end of the operation portion 1 is connected to the hose and is provided with a water inlet channel 1*a* (as shown in FIG. 11).

The housing 2 consists of a first assembly end, an extended second assembly end, a diversion chamber A, a plurality of distribution channels, and a work surface 21. The first assembly end is connected with the operation portion 1 and the diversion chamber A is selectively aligned with and communicating with the distribution channels correspondingly.

Referring to FIGS. 1, 10, 11, and 18, the diversion chamber A of the housing 2 includes a first diversion port 24 and a second diversion port 25, each of which is provided with a water stop ring fitted on surface. The distribution channels include a first distribution channel 2*a*, a second distribution channel 2*b*, and a third distribution channel 2*c*. The diversion chamber A is space over the first diversion port 24 and the second diversion port 25 while the first diversion port 24 is communicating with both the first distribution channel 2*a* and the second distribution channel 2*b*. A pipeline 25*a* is formed by extension of the second diversion port 25 and is communicating with the third distribution channel 2*c*. The water inlet channel 1*a* of the operation portion 1 is connected with the first distribution channel 2*a*.

Referring to FIGS. 1-2 and FIGS. 9-11, a liquid storage room 22 is formed on one side of the work surface 21 and a top surface of the liquid storage room 22 is closed, so that the liquid storage room 22 becomes a space for temporary storage of the liquid. A siphon channel 52 is arranged at one end of the liquid storage room 22 and the other end of the liquid storage room 22 is provided with a delivery channel 29 which is communicating with the third distribution channel 2*c*. The siphon channel 52 is connected with a valve 22*a* and a spring 22*b* is fitted around the valve 22*a* for allowing the valve 22*a* to move and return to the original position axially in the siphon channel 52. The valve 22*a* includes a top end 22*a*1 and a bottom end 22*a*2. The siphon channel 52 is communicating with the liquid pipe 51 of the container 5 and used for delivering concentrated liquid to the liquid storage room 22. The valve 22*a* is used to control size of an opening of the siphon channel 52 for further control of the opening and closing and the amount of the liquid flowing from the siphon channel 52 to the liquid storage room 22. Then the concentrated liquid sent to the liquid storage room 22 is further delivered to the third distribution channel 2*c* by the delivery channel 29.

Referring to FIG. 1, the adjustment portion 3 is connected to the housing 2 and is composed of a rotary button 31, a selector 36, a valve hole 37, and a slide 38 with a through hole 381. The rotary button 31 consists of an assembly hole 311 and a first side portion 312 on one side of the assembly hole 311. The valve hole 37 is mounted on one end of a diameter of the selector 36 which includes a rod portion 361 extended from the center thereof, an axial portion 362 extended from the top end of the rod portion 361, and a second side portion 363 formed on the periphery of the axial portion 362. The adjustment portion 3 is provided with the selector 36 able to be rotated around the central axis of the diversion chamber A freely by manual operation.

The selector 36 is mounted in the diversion chamber A and the valve hole 37 is selectively aligned with one of the first and the second diversion ports 24, 25 and closing the other diversion port 24, 25 while the through hole 381 of the slide 38 is mated with the axial portion 362 of the selector 36 and leaning against the surface on top of the rod portion 361 so that the slide 38 is tightly connected to the diversion chamber A. Thereby the selector 36 is limited at the diversion chamber A, without coming off easily. The axial portion 362 is protruding from the slide 38 and is fastened with a screw after being mounted into the assembly hole 311 of the rotary button 31 by the second side portion 363 aligned with the first side portion 312. Thereby the rotary button 31 is able to be turned on the work surface 21 and the selector 36 is also turned by the rotary button 31 simultaneously.

Figure 3:
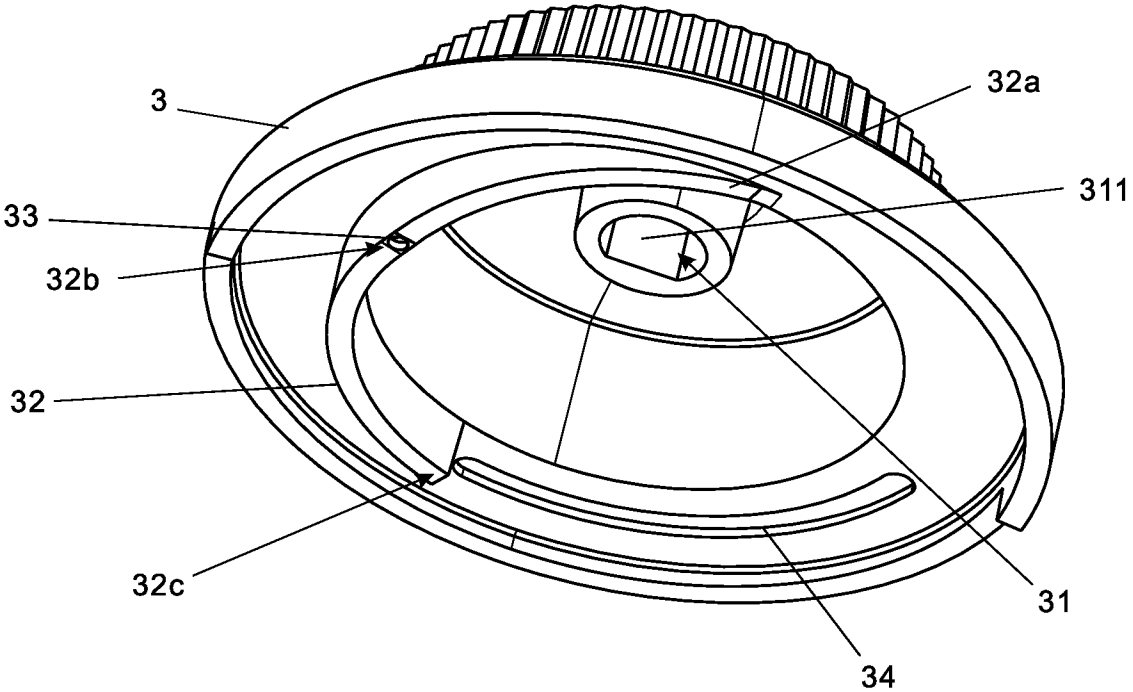
FIG. 3 is a perspective view of a rotary button of an embodiment according to the present invention.
Figure 7:
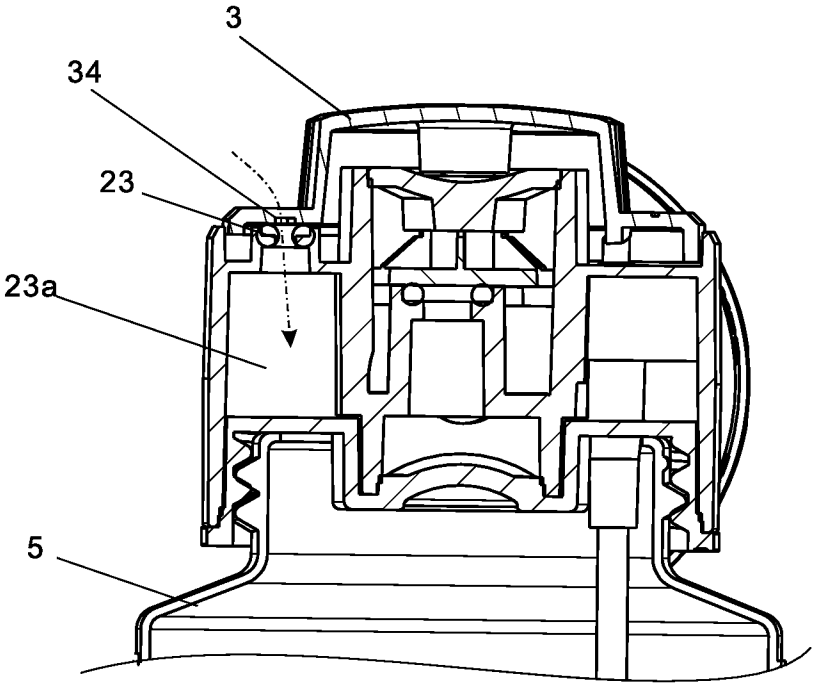
FIG. 7 is a partial sectional view of an embodiment according to the present invention.
Figure 8:
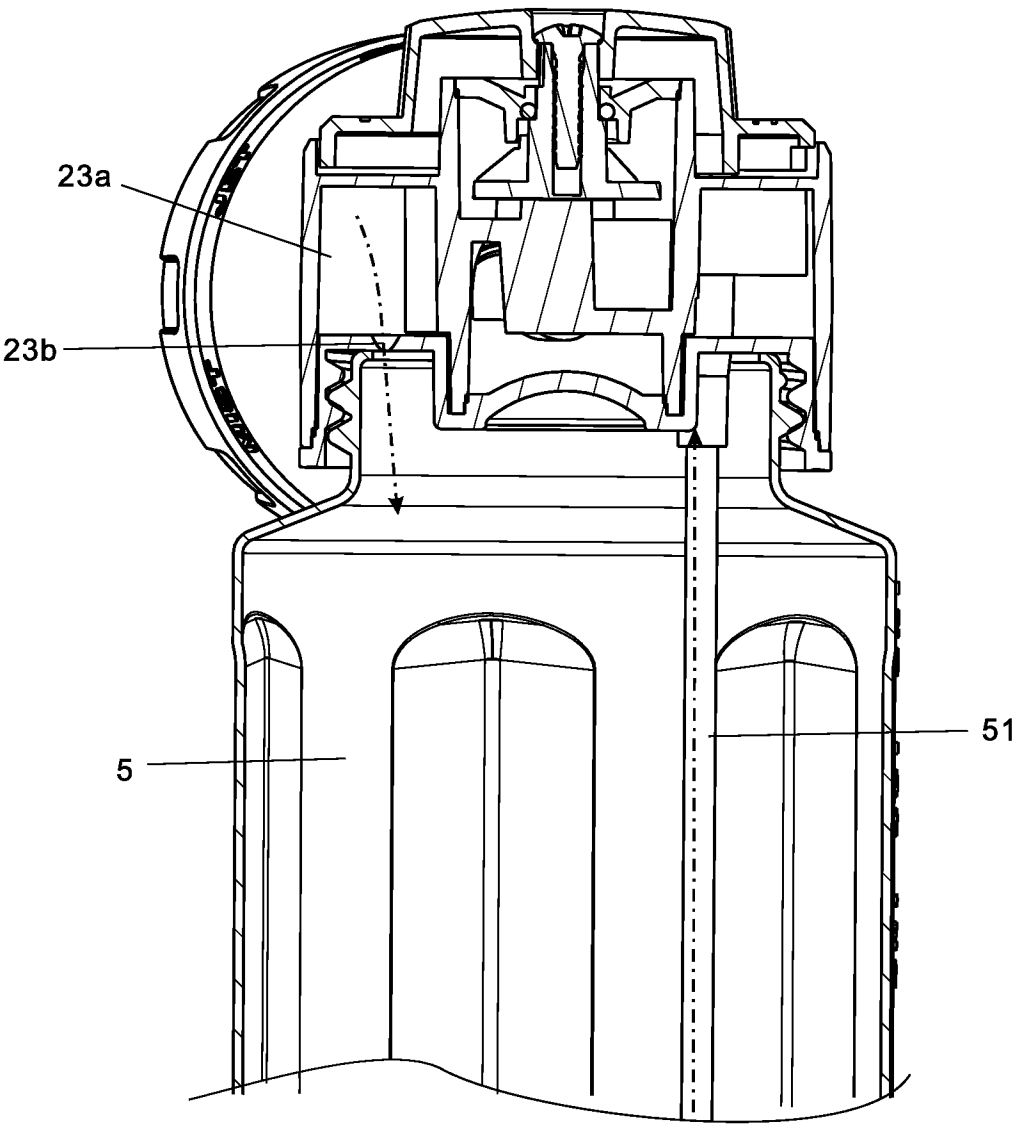
FIG. 8 is another partial sectional view of an embodiment according to the present invention.
Figure 9:
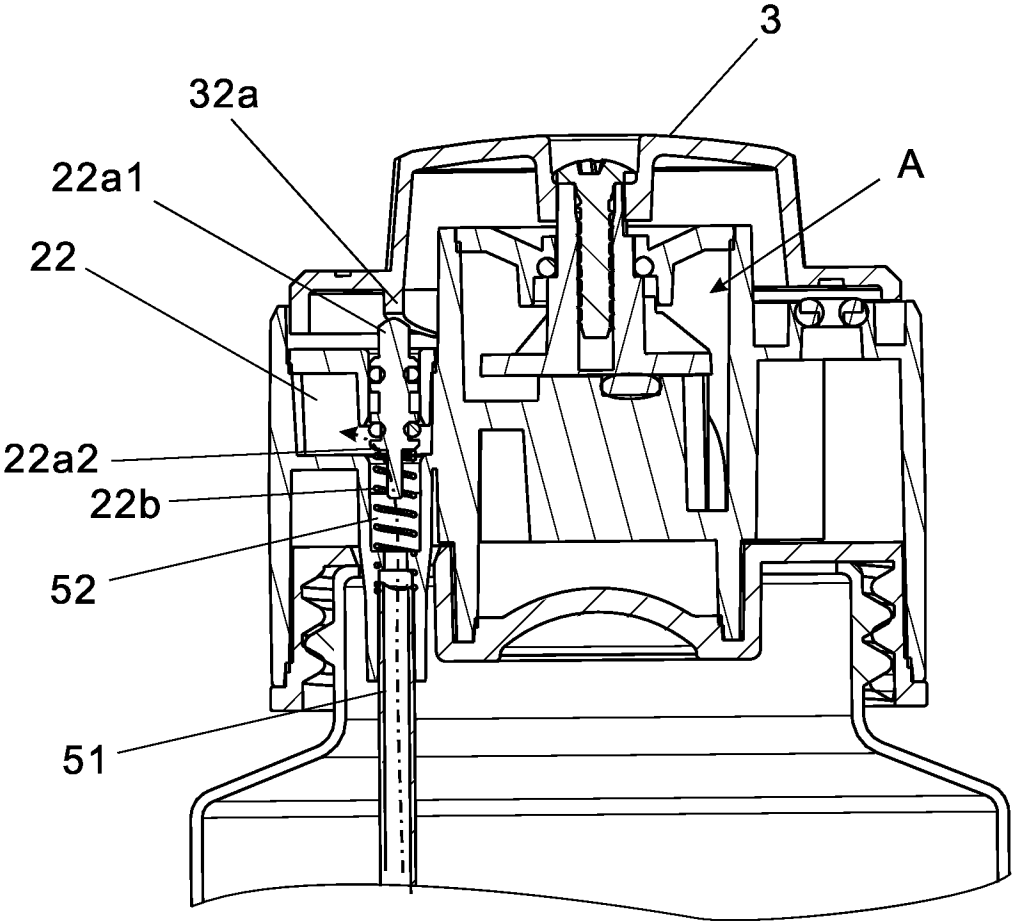
FIG. 9 is a partial sectional view of an embodiment according to the present invention in which a valve is aligned with a first end of a ramp of an adjustment portion.
Figure 10:
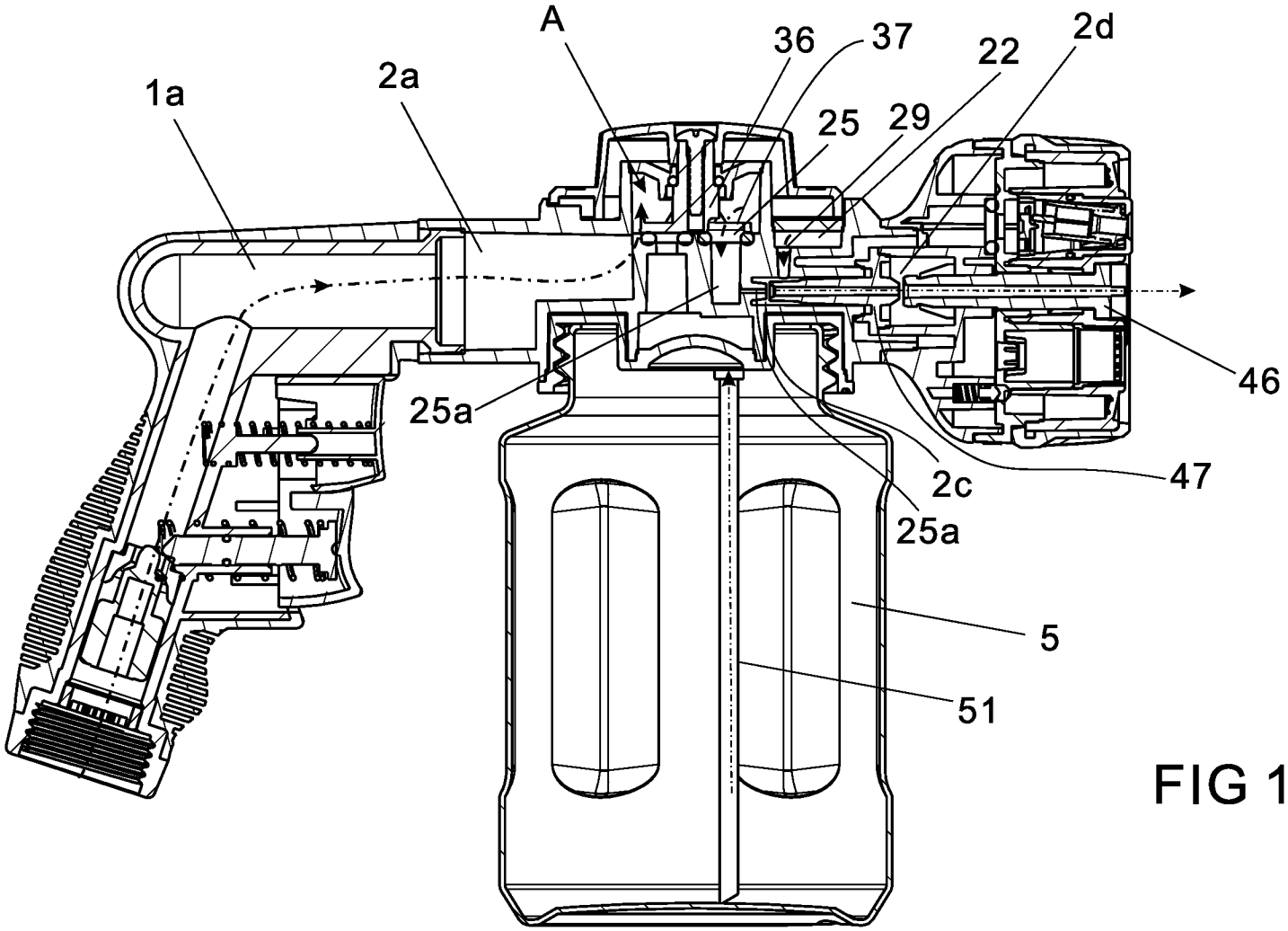
FIG. 10 is a top view of an embodiment according to the present invention showing a diversion chamber and a liquid storage room.
Figure 15:
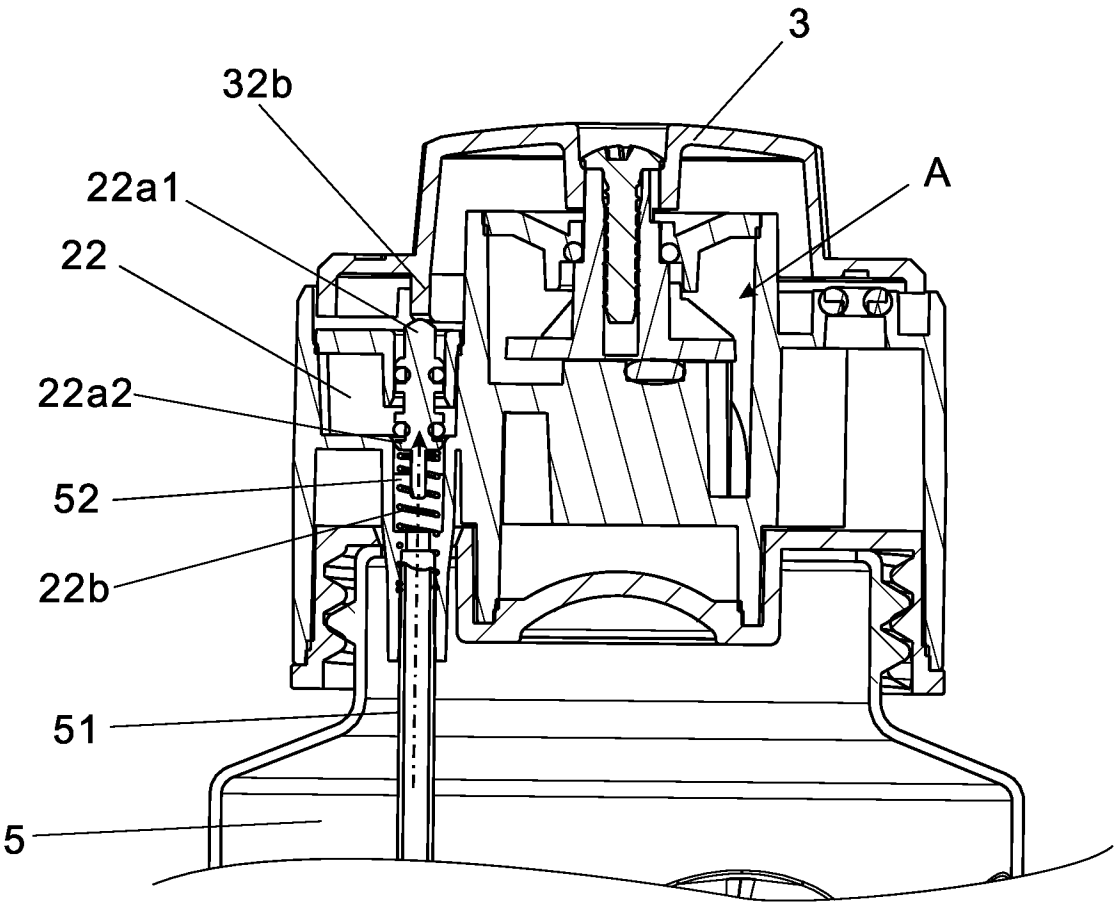
FIG. 15 is a partial sectional view of an embodiment according to the present invention in which a valve is aligned with a second end of a ramp of an adjustment portion.

Referring to FIGS. 3, 7, and 15, a ramp 32 is arranged at the rotary button 31 of the adjustment portion 3 and composed of a first end 32*a*, an extended second end 32*b*, and an extended third end 32*c*. The ramp 32 slopes upward gradually from the first end 32*a* to the second end 32*b* and a locking hole 33 is mounted to the second end 32*b* while the surface between the second end 32*b* and the extended third end 32*c* is kept at the same level. The top end 22*a*1 of the valve 22*a* is abutting against the ramp 32 correspondingly and the vertical movement of the valve 22*a* is controlled by the position of the ramp 32 with respect to the position of the valve 22*a*. Referring to FIGS. 3, 8, and 9, a curved groove 34 is disposed on one end of the ramp 32. The housing 2 is provided with an air channel 23 which is composed of a first vent hole 23*a* located on a top surface and a second vent hole 23*b* located on a bottom surface. The first vent hole 23*a* is communicating with the work surface 21 and the second vent hole 23*b* is communicating with the container 5. An oil seal ring is fitted on the first vent hole 23*a* and the surface of the oil seal ring is abutting against the curved groove 34 of the rotary button 31.

Figure 4:
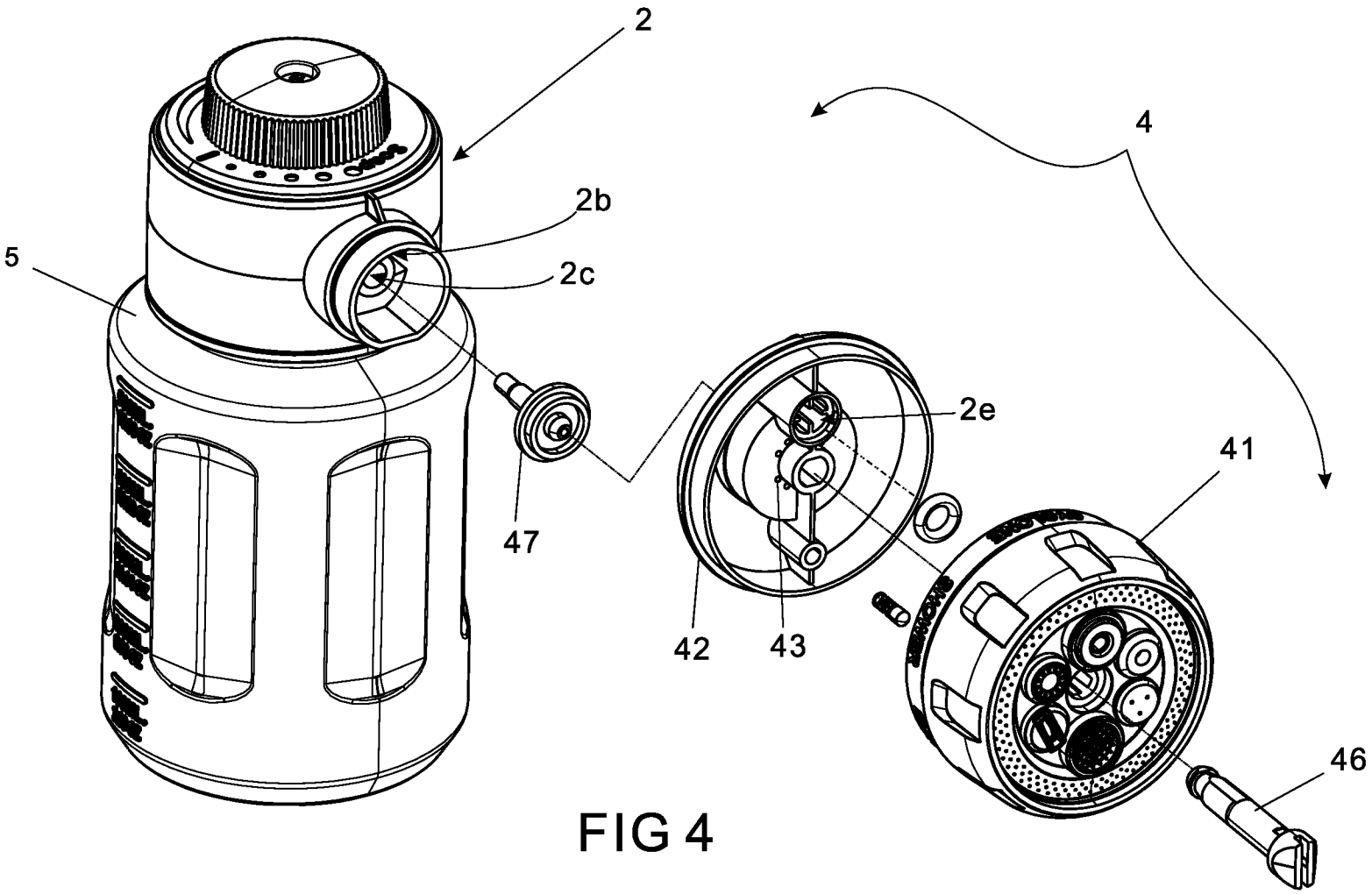
FIG. 4 is another partial assembly diagram and a partial exploded view of an embodiment according to the present invention.
Figure 5:
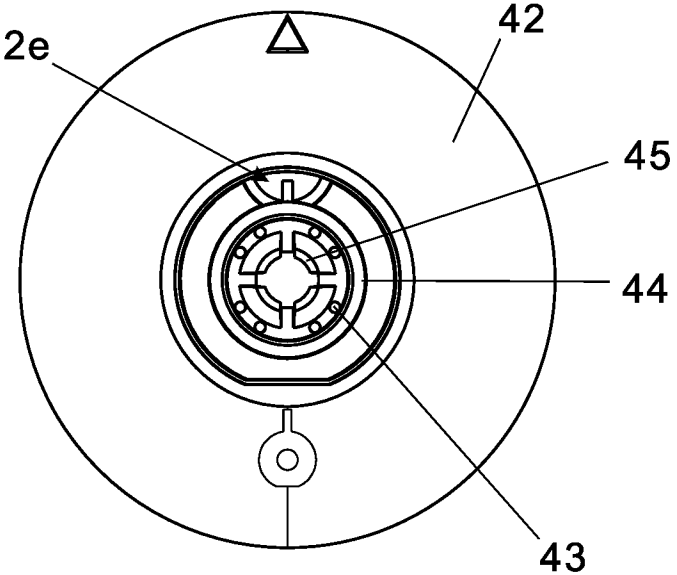
FIG. 5 is a rear view of a rear cover of an embodiment according to the present invention.

As shown in FIGS. 4, 5, 13, and 18, the spray portion 4 is composed of a spray head 41 and a rear cover 42 connected with each other tightly. The rear cover 42 is also connected with the second assembly end of the housing 2 firmly. The spray portion 4 has a mixture channel 2*d* extended and connected to the third distribution channel 2*c* and a clear-water channel 2*e* connected to the second distribution channel 2*a*. The spray head 41 is provided with a plurality of clear-water nozzles 41*a* and a mixture nozzle 46. By the spray head 4 being rotated manually, one of the clear-water nozzles 41*a* is selected and aligned with the clear-water channel 2*e* to spray out the water in one of the various spray patterns, such as linear splash or radial splash. In this embodiment, the clear-water channel 2*e* is formed in the rear cover 42 and is aligned with one of the clear-water nozzles 41*a* of the spray head 41. In other embodiments, the clear-water channel 2*e* is not limited to be mounted in the rear cover 42. The clear-water channel 2*e* is defined to be aligned with one of the clear-water nozzles 41*a* of the spray head 4 being selected and used for receiving water diverted to the second distribution channel 2*b* through the first diversion port 24. As shown in FIG. 4 and FIG. 5, the rear cover 42 includes a first portion 44 which is provided with a mounting hole 45 for mounting the mixture nozzle 46 of the spray head 41 correspondingly and a plurality of air inlet holes 43 arranged around the periphery of the mounting hole 45. The mounting hole 45 is assembled with an assembly nozzle 47 which is aligned with the mixture nozzle 46. Both the assembly nozzle 47 and the mixture nozzle 46 are provided with a passage for output of diluted solution and bubble solution.

Figure 6:
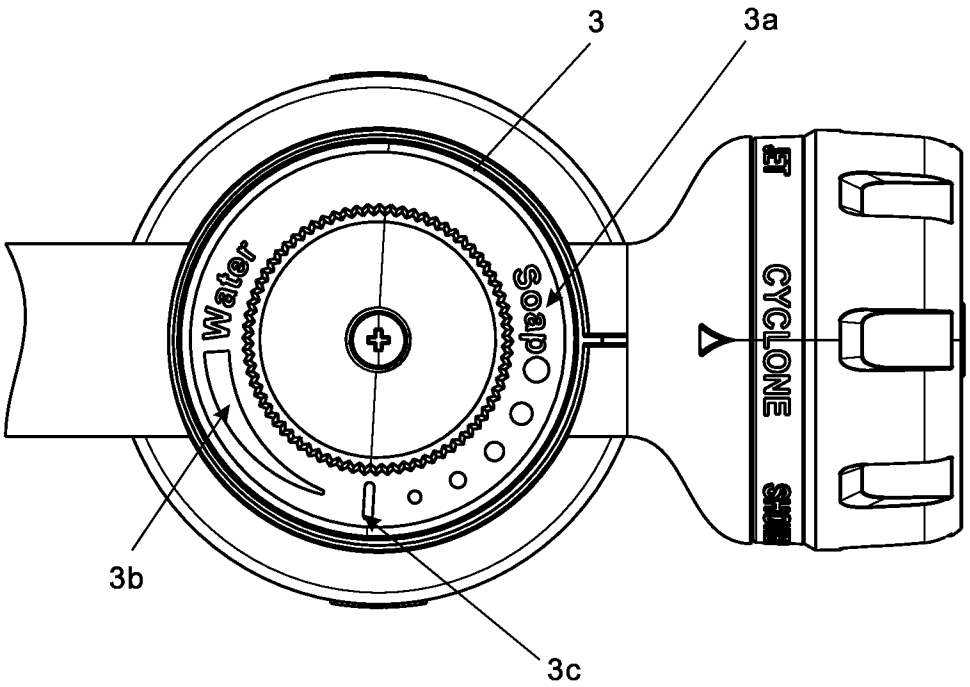
FIG. 6 is a top view of an embodiment in which a Soap mark is aligned with a positioning marker according to the present invention.

Referring to FIGS. 6-14, how bubbles are sprayed out is revealed. As shown in FIG. 6, one may rotate the rotary button 31 of the adjustment portion 3 to make a Soap marker 3*a* align with the positioning marker and the valve hole 37 on the selector 36 will be aligned with the second diversion port 25 while the first diversion port 24 is closed. Referring to FIG. 8 and FIG. 9, the curved groove 34 of the rotary button 31 is aligned with the first vent hole 23*a*. Also, referring to FIG. 10, by the operation portion 1, water is introduced, flowing through the first distribution channel 2*a* and into the second diversion port 25 to generate a negative pressure. Thereby, air is introduced into the air channel 23 through the first vent hole 23*a*, then passed through the second vent hole 23*b* and entered the container 5. Owing to the air pressure, liquid in the container 5 is delivered to the siphon channel 52 through the liquid pipe 51 to have siphon effect by which the liquid is further delivered up to the valve 22*a* through the liquid pipe 51*b*. Now as shown in FIG. 9, the first end 32*a* of the ramp 32 is aligned with the top end 22*a*1 of the valve 22*a* and the valve 22*a* is pushed by the spring 22*b* to move upward, so that the bottom end 22*a*2 of the valve 22*a* is opened and communicating with the siphon channel 52. As shown in FIGS. 11-14, water from the second diversion port 25 is flowing through the pipeline 25*a* and diverted into the third distribution channel 2*c*. At the same time, the liquid in the liquid storage room 22 is flowing into the third distribution channel 2*c* through the delivery channel 29 and mixed with the water from the pipeline 25*a* to form the diluted solution. Lastly, the diluted solution is mixed with air from the air inlet holes 43 by the impact of water flow while arriving the mixture channel 2*d* to form bubble solution at the mixture channel 2*d*. Then, the bubble solution is sprayed out through the mixture nozzle 46.

Although the diluted solution is blended with the air to form the bubble solution at the mixture channel 2*d* as mentioned above, the bubble solution with specific features in the sprayer can also be formed in one of other distribution channels of the housing 2. For example, the mixture channel 2*d* can be an extension of the third distribution channel 2*c* to the mixture nozzle 46 and the clear-water channel 2*e* can be an extension of the second distribution channel 2*b* to the clear-water nozzle 41*a*.

Referring to FIGS. 6, 9, and 15, the concentration of the bubble solution is adjusted in this embodiment. One may rotate the rotary button 31 to make a large-to-small marker of the Soap marker (for bubble solution) 3*a* align with the positioning marker. The ramp 32 slopes upward gradually from the first end 32*a* to the second end 32*b*, so that the valve 22*a* is able to be pressed downward when the ramp 32 presses against the top end 22*a*1 of the valve 22*a*. The opening of the siphon channel 52 is further minimized by the bottom end 22*a*2 of the valve 22*a* so that the amount of the liquid flowing into the liquid storage room 22 is gradually reduced. As shown in FIG. 9, the opening of the siphon channel 52 is opened to the maximum when the top end 22*a*1 of the valve 22*a* is abutting against the first end 32*a* of the ramp 32. Thereby a lot of liquid is flowing into the liquid storage room 22 and then entering the third distribution channel 2*c* through the delivery channel 29 for being mixed with the water from the pipeline 25*a* and obtaining the diluted solution with higher concentration. Lastly, the diluted solution is blended with air from the air inlet holes 43 by impact of water flow while arriving the mixture channel 2*d* to form bubble solution with higher concentration that is sprayed out through the mixture nozzle 46. On the other hand, as shown in FIG. 15, the top end 22*a*1 of the valve 22*a* is abutting against the second end 32*b* of the ramp 32, so that the opening of the siphon channel 52 is opened to the minimum degree. Thus only a little amount of liquid is flowing into the liquid storage room 22 and then entering the third distribution channel 2*c* through the delivery channel 29 to be mixed with the water from the pipeline 25*a* and getting the diluted solution with lower concentration. Lastly, the diluted solution is blended with air from the air inlet holes 43 by impact of water flow while arriving the mixture channel 2*d* to form bubble solution with lower concentration to be sprayed out through the mixture nozzle 46.

Based on the above arrangement, rotation of the rotary button 31 is used to adjust the amount of the concentrated solution flowing into the liquid storage room 22 by siphon effect and further control the concentration of the bubble solution sprayed out.

Figure 16:
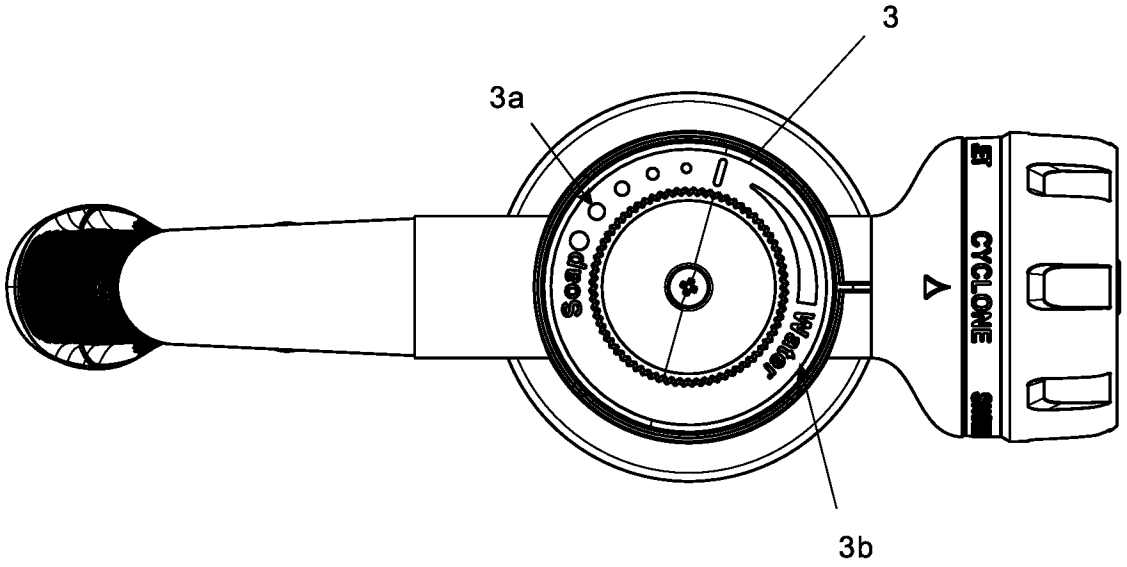
FIG. 16 is a top view of an embodiment according to the present invention in which a Water marker is aligned with a positioning marker.
Figure 17:
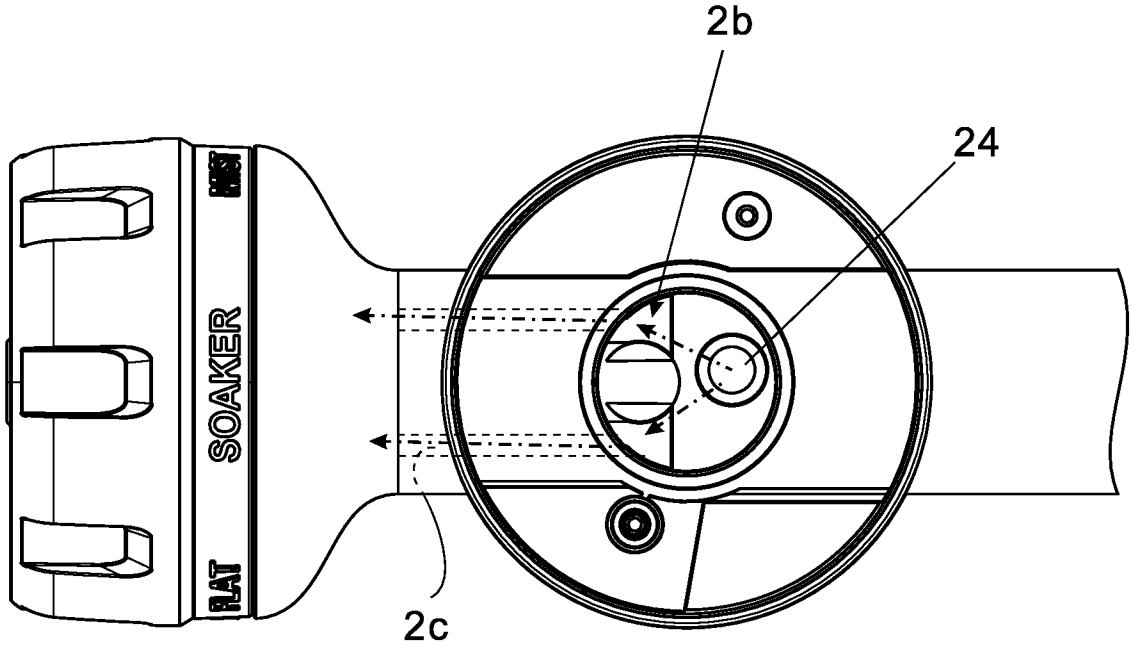
FIG. 17 is a bottom view of an embodiment according to the present invention.
Figure 18:
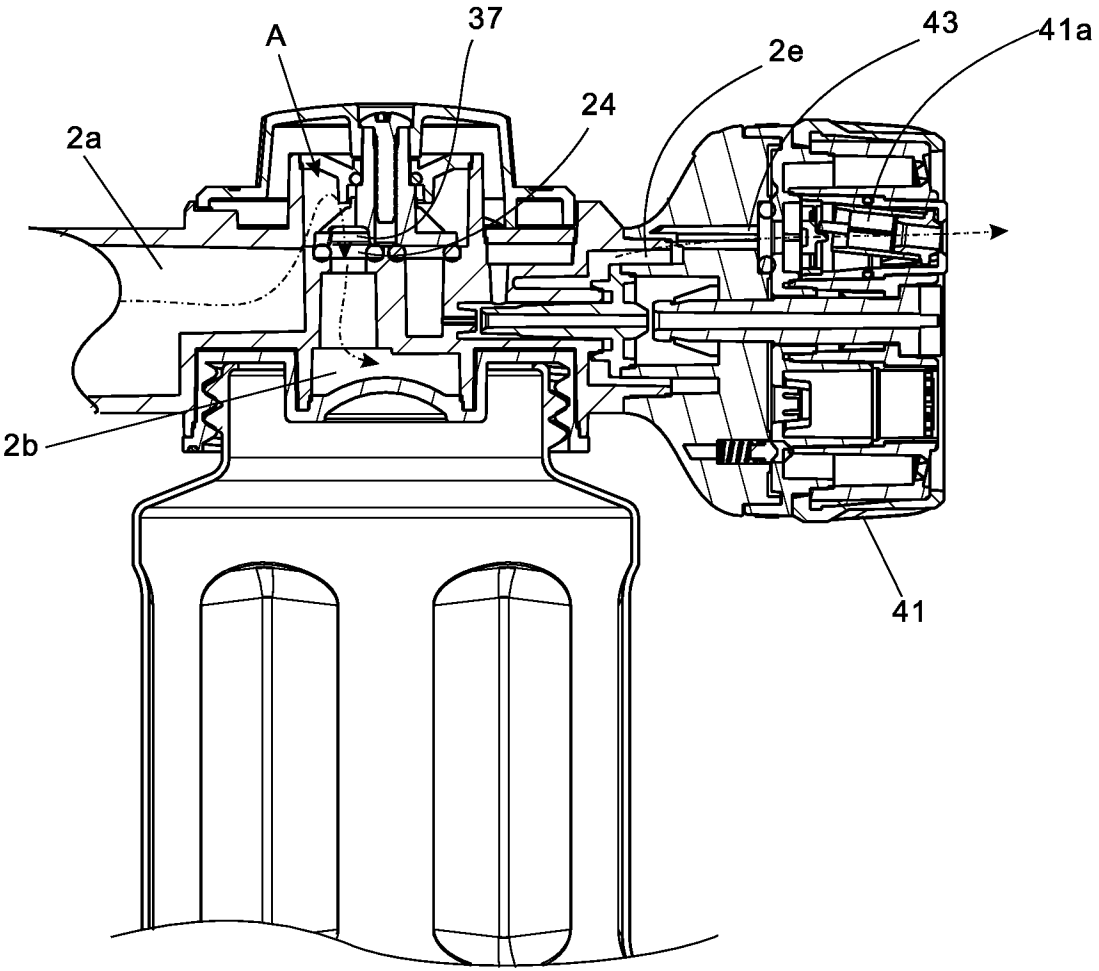
FIG. 18 is a schematic drawing showing how water is sprayed out of an embodiment according to the present invention.

Referring to FIGS. 16-18, an embodiment which is adjusted to spray water only is revealed. One may rotate the rotary button 31 of the adjustment portion 3 to make a Water marker 3*b* align with the positioning marker. Therefore, the valve 22*a* is abutting against the area between the second end 32*b* and the third end 32*c* of the ramp 32, so that the valve 22*a* is pressed downward to close the opening of the siphon channel 52. The valve hole 37 on the selector 36 is aligned with the first diversion port 24 while the second diversion port 25 is closed. By the operation portion 1, water is introduced and flowing into the first distribution channel 2*a*, through the diversion chamber A, the first diversion port 24, and then into the second distribution channel 2*b*, as shown in FIG. 17. Lastly the water reaches the clear-water channel 2*e* to be sprayed out through the selected clear-water nozzles 41*a* of the spray head 41. This is the clear-water mode, as show in FIG. 18.

Figure 19:
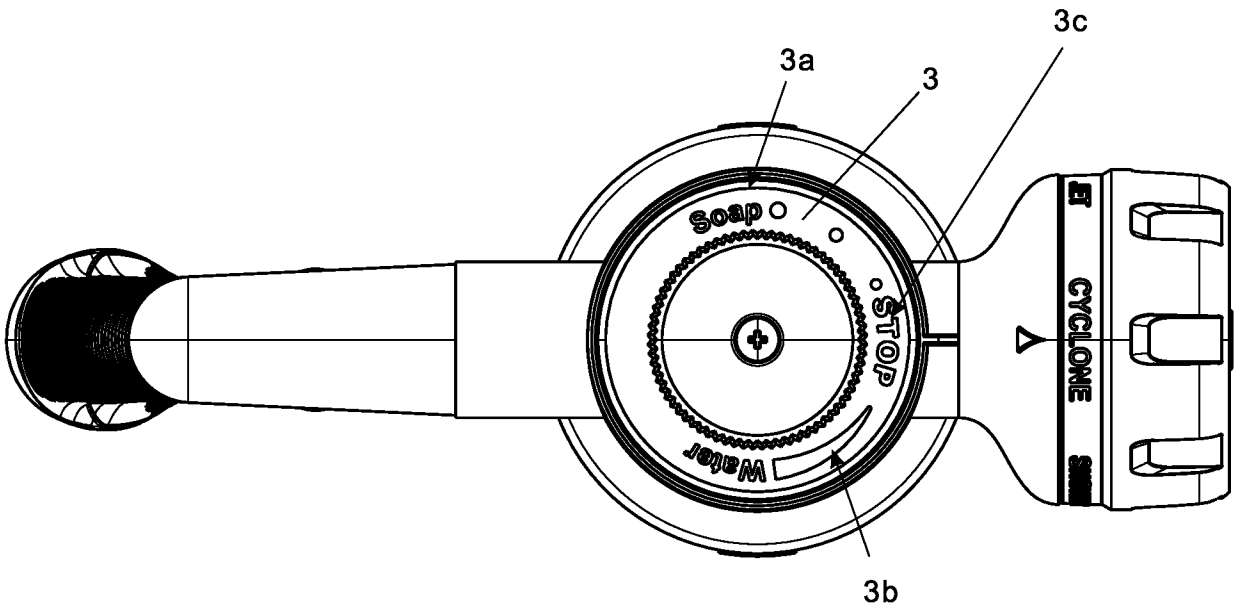
FIG. 19 is a top view of an embodiment according to the present invention in which a STOP mark is aligned with a positioning marker.
Figure 20:
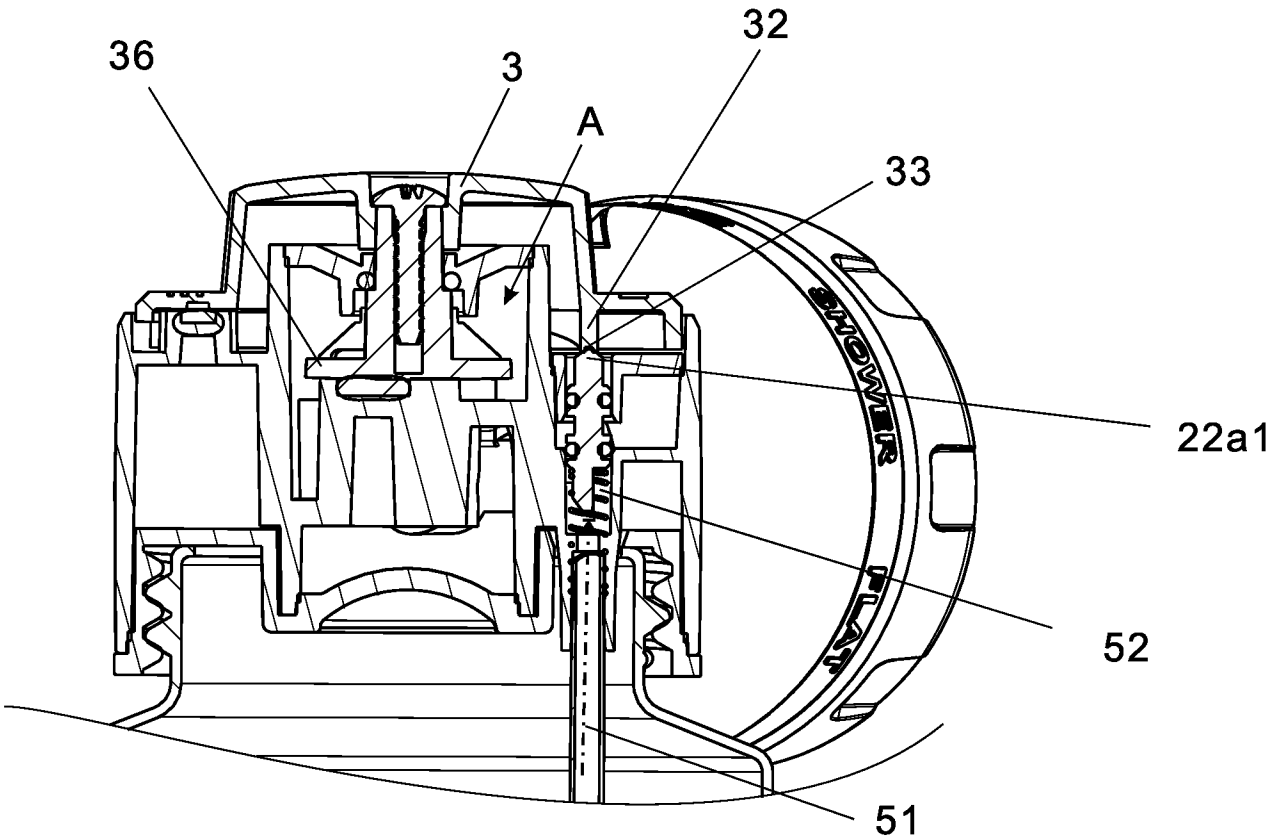
FIG. 20 is a partial sectional view of an embodiment according to the present invention in which a valve is aligned with a locking hole of a ramp.

As shown in FIG. 19 and FIG. 20, one may stop spraying of the bubble solution by rotating the rotary button 31 of the adjustment portion 3 to make the STOP marker 3*c* align with the positioning marker. Therefore, both the first diversion port 24 and the second diversion port 25 are closed by the selector 36 at the same time. The locking hole 33 at the second end 32*b* of the ramp 32 of the rotary button 31 is mounted with the top end 22*a*1 of the valve 22*a* and the valve 22*a* is pressed downward so that the opening of the siphon channel 52 is closed by the bottom end 22*a*2 of the valve 22*a*.

In summary, the sprayer according to this embodiment of the present invention features on that the spray portion 4 is connected to the housing 2 which is provided with the mixture channel 2*d* and the clear-water channel 2*e* while the diversion chamber A can be selected to be communicated with either the mixture channel 2*d* or the clear-water channel 2*e*. The spray head 41 which can be rotated manually is provided with a plurality of clear-water nozzles 41*a* arranged around the mixture nozzle 46. One of the clear-water nozzles 41*a* is selected by manual rotation of the spray head 41 to be aligned with the clear-water channel 2*e* and the mixture nozzle 46 is aligned with the mixture channel 2*d*. The adjustment portion 3 is rotated manually to be aligned with the diversion chamber A for allowing water flowing to the selected clear-water nozzle 41*a* and then sprayed out in different patterns. Or the adjustment portion 3 is rotated manually to be aligned with the diversion chamber A for allowing both water and concentrated liquid flowing into the mixture channel 2*d* and then the mixed solution is sprayed out through the mixture nozzle 46.

The present sprayer has the following operation modes.

Mode 1: the water is flowing into the first diversion port 24 through the diversion chamber A and then sprayed out through one of the clear-water nozzles 41*a* selected. Under this mode, only water is provided and sprayed for washing or other purposes.

Mode 2: the water is introduced into the second diversion port 25 through the diversion chamber A and mixed with the liquid from the container 5 in the channel of the housing 2 to form the diluted solution. Then the diluted solution is mixed with external air while reaching the spray portion 4 to form the bubble solution to be sprayed out through the mixture nozzle 46. Under this mode, the bubble solution is provided and sprayed for washing.

Mode 3: the rotary button 31 is rotated for adjustment of the amount of liquid flow. Owing to design of the ramp 32 of the rotary button 31, the valve 22*a* is adjusted to open the opening of the siphon channel 52 in a stepless manner. Thereby the amount of the liquid flowing into the liquid storage room 22 of the housing 2 can be adjusted. The liquid provided is mixed with water to get the diluted solution and the concentration of the diluted solution is further controlled by the amount of the liquid provided. The concentration of the bubble solution obtained can also be adjusted.

Mode 4: a washing mode used to control the concentration of the bubble solution or the amount of water being provided and sprayed out.

Mode 5: To stop spraying, one may select the stop mode so that both the first diversion port 24 and the second diversion port 25 are closed. Under this mode, no solution/liquid is able to be sprayed out.

The present invention features on the mode 3 by which the concentration and the spray patterns of the liquid are adjustable. The concentration of the mixed solution formed by the liquid blended with water can be selected because that the flow of the liquid drawn by siphon effect can be adjusted.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A sprayer, comprising:

a housing;

an adjustment portion, connected to the housing;

a spray portion, connected to the housing; and a container connected to the housing, wherein the sprayer is characterized in that the housing includes a work surface, a diversion chamber composed of a first diversion port and a second diversion port, and a plurality of distribution channels, wherein a liquid storage room is disposed on one side of the work surface, wherein a siphon channel is arranged at one end of the liquid storage room, while the other end of the liquid storage room has a delivery channel communicated with a mixture channel, wherein the siphon channel has a valve, adapted to move and return in the siphon channel, wherein a ramp is arranged at a rotary button of the adjustment portion and an upper end of the valve is abutting against the ramp correspondingly, so that movement of the valve is controlled by the position of the ramp with respect to the valve and the valve is used to control size of an opening of the siphon channel for further control of the opening and closing and the amount of liquid flowing from the siphon channel to the liquid storage room.

2. The sprayer, as recited in claim 1, wherein a locking hole is mounted to a second end of the ramp.

3. The sprayer, as recited in claim 1, wherein the distribution channels of the housing include a first distribution channel, a second distribution channel, and a third distribution channel, wherein the first diversion port is communicated with both the first distribution channel and the second distribution channel, while the second diversion port has a pipeline extended from the second diversion port and communicated with the third distribution channel.

4. The sprayer, as recited in claim 1, wherein the adjustment portion includes the rotary button, a selector, and a slide with a through hole arranged thereon, wherein the rotary button consists of an assembly hole and a first side portion on one side of the assembly hole, wherein a valve hole is mounted on one end of a diameter of the selector which includes a rod portion extended from the center thereof, an axial portion extended from top of the rod portion, and a second side portion formed on periphery of the axial portion.

5. The sprayer, as recited in claim 4, wherein the selector is mounted in the diversion chamber and the valve hole is aligned with the first diversion port or the second diversion port selectively while the through hole of the slide is mated with the axial portion of the selector and leaning against a top surface of the rod portion, so that the slide is tightly connected to the diversion chamber, so that the selector is limited at the diversion chamber, wherein the axial portion is protruded from and fastened after being mounted into the assembly hole of the rotary button by the second side portion aligned with the first side portion, so as to allow the rotary button to be turned on the work surface, which turns the selector simultaneously.

6. The sprayer, as recited in claim 1, wherein the housing includes an air channel which has a first vent hole located on a top surface thereof and a second vent hole located on a bottom surface thereof, wherein the first vent hole is communicated with the work surface and the second vent hole is communicated with the container.

7. The sprayer, as recited in claim 3, wherein the spray portion 4 is composed of the spray head and a rear cover connected with each other, wherein the rear cover is connected to the housing, wherein the spray portion further includes a mixture channel connected to the third distribution channel and a clear-water channel connected to the second distribution channel, wherein the spray head has a plurality of clear-water nozzles and a mixture nozzle, wherein one of the clear-water nozzles is selected and aligned with the clear-water channel by manual rotation of the spray head, so as to allow water to be sprayed out in designated spray patterns, wherein the clear-water channel is formed in the rear cover and aligned with one of the clear-water nozzles of the spray head for receiving water diverted to the second distribution channel through the first diversion port, wherein the rear cover includes a first portion which has the mixture nozzle corresponding to the spray head.

8. The sprayer, as recited in claim 1, wherein a spring is fitted around the valve.

9. The sprayer, as recited in claim 7, wherein the clear-water channel is an extension of the second distribution channel to the clear-water nozzles.

10. The sprayer, as recited in claim 7, wherein the mixture channel is an extension of the third distribution channel to the mixture nozzle.

11. The sprayer, as recited in claim 1, wherein the ramp includes a first end, an extended second end, and an extended third end, wherein the ramp slopes upward gradually from the first end to the second end while a surface between the second end and the extended third end is kept at the same level.

12. The sprayer, as recited in claim 1, wherein the siphon channel is communicated with a liquid pipe of the container for providing and delivering liquid to the liquid storage room.

13. The sprayer, as recited in claim 1, wherein the liquid is selected from the group consisting of fertilizers, pesticides, detergents, and the combinations thereof.

* * * * *